US005922010A

United States Patent [19]

Alanen et al.

[11] Patent Number: 5,922,010

[45] **Date of Patent: *Jul. 13, 1999**

[54] PACIFIER

[76] Inventors: Pentti Alanen, Papinkatu 18, Loimaa; Juha Varrela, Vartiovuorenkatu 7 A 14, Turku, both of Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,508

[22] PCT Filed: Oct. 4, 1995

[86] PCT No.: PCT/FI95/00542

§ 371 Date: Jun. 27, 1997

§ 102(e) Date: Jun. 27, 1997

[87] PCT Pub. No.: WO96/20687

PCT Pub. Date: Jul. 11, 1996

Related U.S. Application Data

[30] Foreign Application Priority Data

Dec. 30, 1994 [FI] Finland ..... 946191

[51] Int. Cl.[6] ..... A61J 17/00

[52] U.S. Cl. ..... 606/236

[58] Field of Search ..... 606/234, 235, 606/236; D24/194–199

[56] References Cited

U.S. PATENT DOCUMENTS 3,924,621 12/1975 Cassimally ..... 606/236
4,381,785 5/1983 Robbins ..... 606/236
4,993,568 2/1991 Morifuji et al. .
5,035,340 7/1991 Timmons .

FOREIGN PATENT DOCUMENTS 2 278 549 12/1994 United Kingdom .

*Primary Examiner*—Michael H. Thaler
*Attorney, Agent, or Firm*—Burns, Doane, Swecker & Mathis, L.L.P.

[57] ABSTRACT

A baby pacifier includes an actual nipple part and a shield. The actual nipple part includes a piece made of elastic or resilient material that is adapted to be held in the baby's mouth at a location between the middle section of the palate and the tongue, and on which piece the baby exerts suction by movements of the jaws and the tongue. The actual nipple part is shaped so that a vertical cross-sectional profile, viewed in a vertical cross-sectional plane of the buccal cavity, is elongated with protrusions directed from the a middle part of the vertical cross-sectional profile to both sides extending to the alveolar ridges and/or the teeth of the baby's upper jaw. The protrusions are shaped so as to create from the baby's sucking motion principally lateral outward pressure on the inside of the alveolar ridges and deciduous teeth of the baby when the actual nipple part is held in a baby's mouth. The vertical cross-sectional profile of the actual nipple part is slightly V-shaped or the upper edge of the cross-sectional profile has a downwards curvature so that the actual nipple part exerts essentially no pressure on the middle section of the palate.

18 Claims, 2 Drawing Sheets

PACIFIER

The invention relates to a baby pacifier comprising an actual nipple part and a pacifier shield.

Earlier it was a common belief that dental malalignment derive from hereditary factors. Therefore, chance of success of preventive treatment was regarded low. However, recent studies suggest that environmental factors play a more significant role than previously believed. The early stages of growth are probably decisive in determining the course in which the growth of the jaws will be directed.

Literature data on the variation of the frequency of dental malalignment in relation to e.g. breast feeding and bottle feeding as well as to the use of pacifier agree well with the assumption that the pacifier leads to incorrect use of the tongue and the facial muscles and may thereby deform the structure of the jaws.

It has been proved that malalignment in the permanent dentition is quite often preceded by a narrowed dental arch of the deciduous dentition of the upper jaw. Reduced lateral growth of the upper jaw during the deciduous stage has proved to be an important underlying factor in great part of the dental malocclusion cases. It can be estimated that at least in 20–40% of children the upper jaw remains so narrow that it leads to disproportion between the upper and lower dental arches like cross bite and distal bite ratio or contraction of the dental arch. These types of dental malocclusion do not always heal spontaneously but require treatment at some stage of development of the dentition. In practice, a method for straightening the teeth, in which the dental malalignement can be corrected by expanding the dental arch of the upper jaw, is gaining more popularity in clinical treatment.

The adverse influence of pacifiers to the bite of the front teeth is generally recognized and new pacifier solutions have been suggested for removing the drawbacks. Among other things, it has been stated that a pacifier in the mouth prevents normal dental occlusion directing the bite primarily to the front teeth. The Swedish publication SE 403 885 suggests a pacifier structure in which bails lying between the teeth of the upper and lower jaws are incorporated with the pacifier to transfer the weight of the bite from the front teeth to the back teeth. However, the solution does not change the pressure caused by sucking on the teeth of the upper jaw to normal direction.

The U.S. Pat. No. 3,924,621 presents a pacifier, in which the neck has been narrowed by forming it from several separate parts so that the child need not keep his mouth as open as with conventional pacifiers. Furthermore, separate parts of the neck allow the tongue to touch the teeth of the upper jaw. However, the solution does not increase the lateral pressure in the region of deciduous molars and deciduous canine teeth which would enhance breadthwise growth of the upper jaw.

The U.S. Pat. No. 5,133,740 suggests a pacifier solution for promoting the growth of the lower jaw. The pacifier is partly two-piece. The upper part chiefly consists of a conventional pacifier. The lower part consists of a pacifier part which places itself between the tongue and the lower teeth with the purpose to force the lower jaw to move forwards to settle in its normal position.

Furthermore, the U.S. Pat. No. 4,993,568 depicts a feeding pacifier provided with a partition with an opening. The partition prevents the food from flowing too easily into the child's mouth thereby forcing the child to make certain sucking movements with the tongue needed in natural breast feeding. The purpose is to prevent a situation in which the child gets used to bottle feeding from indolence and abandons breast feeding.

Most recent research results now verify that infant sucking habits have a connection with the breadthwise growth of the upper jaw. When the child sucks the pacifier, a pressure directed towards the midline is exerted on the teeth and the alveolar ridge of the upper jaw in the region of deciduous canine teeth and deciduous molars having a negative effect on the breadthwise growth of the upper jaw.

Furthermore, it has been shown that sucking of the pacifier generates a negative pressure in the mouth. This negative pressure may for its own part contribute to the hindered breadthwise growth of the upper jaw, which leads to locking of the teeth at the eruption stage so that the growth will be disturbed and malalignment will develop in the bite.

Normally the tongue induces an opposite, lateral pressure on the teeth and the alveolus which is slightly higher than the medial pressure and has a positive effect on the breadthwise growth of the upper jaw from the midsuture to the lateral direction.

Conventional pacifiers fill the upper part of the buccal cavity, within the middle section of the buccal cavity, pressing the tongue to a position below normal so that the tongue is not in contact with the teeth of the upper jaw nor with the alveolar ridges. It is obvious that in using a conventional pacifier—an increase in the pressure directed medially and induced by the function of the lips and the cheeks —internal negative pressure in the mouth —pressure induced by the function of the tongue acting primarily through the pacifier on the palate, and —missing of the normal lateral pressure caused by the tongue together generate the effect which hinders the lateral growth of the upper jaw. The daily time of use of the pacifier may be quite long with some children and therefore the negative effect caused by the use of the pacifier on the growth of the upper jaw is considerable.

The drawback with feeding bottles is often the fact that milk or other food comes through the pacifier without any sucking efforts from the child but rather the child has to obstruct with his tongue too easy and rapid flow of milk into his mouth. This leads to an incorrect use of the muscles. For a correct muscle stimulation, use of a pacifier should, on the contrary, simulate the effort required in breast feeding. Normal breast sucking and the subsequent swallowing activity involve strong action of the tongue, cheeks, and lips, forward movement of the lower jaw during the sucking stage, backward movement of the lower jaw during the act of swallowing. These movements guide the growth of the jaws and strengthen the muscles of the mouth. A conventional feeding pacifier does not stimulate the child to this kind of movement. If all feeding is carried out with a feeding bottle and a feeding pacifier, the daily time of use is easily several hours. Furthermore, some children use the feeding bottle for drinking water or juice and then the time of use of the pacifier may be considerably longer and the effect of the pacifier on the growth of the child's upper jaw or on the retardation of the growth may turn out harmful.

The British patent application GB 2278549 depicts a pacifier which has a central part having wings extending therefrom to both sides to the alveolar ridges. The pacifier depicted in this publication suffers however from some drawbacks. An ordinary pacifier is so large compared to the size of the mouth of a newborn baby that any wings will not fit into the mouth unless the ball-shaped main part is made very small. The child would not use this kind of pacifier with no nipple-like part to suck. If the baby in the beginning gets used to another kind of pacifier, introduction of a wing pacifier will be hardly successful. Transition from a conventional pacifier to that of the invention described in the application is mentioned on page 6, lines 8–12 of the publication. For reasons of habituation this transition is difficult for the child and probably takes place too late. Breadthwise growth of the upper jaw must be activated from the beginning because use of a conventional pacifier before use of a pacifier of a new design has time to cause, besides habituation, injurious effects depicted in the publication, retardation in the breadthwise growth. The pacifier described in this publication would produce advantageous effects only if the use of this pacifier were continued for a relatively long time. Furthermore, due to the reasons of size mentioned above, the wings are bound to be relatively thin parts which the child can bite off and swallow. Therefore, for reasons of safety the wing structure is not suitable as a pacifier.

Furthermore, known pacifiers, including that of the GB patent application mentioned above, suffer from the drawback that they, due to inward and outward forces acting on the pacifier, press the front part of the alveolar ridge from the inside and thereby cause protrusion of the front part of the dental arch.

The objective of this invention is to accomplish an improved pacifier wherein said harmful effects of a pacifier on the breadthwise growth of a child's jaw have been minimized. It is not the objective of this invention to prolong the time of use of the pacifier, but on the contrary keep it short but as correct as possible during that time. For this reason, it is important to use such a pacifier from the beginning that has an activating effect on the breadthwise growth of the upper jaw.

The objective of this invention is to accomplish a pacifier which does not have a retarding effect on the breadthwise growth of the dental arch of the upper jaw but which directs the functional forces involved in sucking so that the breadthwise growth is activated.

The purpose is especially to accomplish a pacifier which creates favourable conditions in the mouth of the child for the breadthwise growth of the upper jaw like a pressure, which simulates the lateral pressure caused by the tongue, on the teeth and the alveolar ridges.

In particular, the purpose is to accomplish a pacifier which will not come into contact with the front part of the alveolar ridge by the effect of the outward and inward forces acting on the pacifier but, on the contrary, exerts pressure on the lateral parts of the alveolar ridges while moving in the mouth forwards.

The characteristic features of the invention appear in claim 1.

In the solution according to the invention, the actual nipple part of a pacifier of a 0–3 years old baby is shaped so that the cross-sectional profile of the nipple part, viewed in a vertical cross-sectional plane of the buccal cavity, is slightly elongated. Protrusions directed from the middle part of said cross-section to both sides extend to the alveolar ridges and/or the teeth of the baby's upper jaw.

The protrusions are shaped so that they create from the baby's sucking motion principally lateral outward pressure on the inside of said alveolar ridges and deciduous teeth. The protrusions are preferably made so as to extend to the alveolar ridges and/or the teeth principally from the deciduous canine backwards to the second deciduous molar.

In the pacifier solution according to the invention, the natural lateral pressure induced by the tongue and the internal support provided by the tongue are replaced by the contact of the protrusions with the teeth and the alveolar ridges of the upper jaw. Thus the upward pressure induced by the tongue activity is transmitted via the protrusions from the inside of the buccal cavity laterally to the alveolar ridges and teeth, preferably from the deciduous canine backwards to the second deciduous molar.

The pacifier according to the invention is preferably designed so that it will not come into an essential contact with the middle section of the palate so that no harmful pressure acts on the actual growth zone, within the middle suture. To prevent generation of any pressure, the vertical cross-sectional profile is slightly shaped into a V-form which ensures that the middle part of the pacifier will not press nor touch the middle section of the palate.

According to a preferred embodiment of the invention the cross-sectional profile of the nipple part in a horizontal cross-sectional plane of the buccal cavity broadens towards the back of the buccal cavity and is approximately trapezoidal. Due to this shape the nipple part cannot come into contact with the front part of the alveolar ridge by any force acting on the nipple part neither can the nipple part move forwards in the mouth without inducing pressure on the lateral parts of the alveolar ridges.

The nipple part is typically made of a resilient or elastic solid material like rubber, latex, or plastic, i.e. it can be manufactured preferably from the same materials as the current pacifiers. The pacifier may be made of a solid or hollow material.

In one embodiment of the invention, the nipple part has a hollow interior containing slowly flowing substance like a gel-like substance which on sucking of the nipple moves from the hollow space of the middle part of the nipple part into the hollow space of the protrusions whereupon the protrusions cause a lateral pressure on the alveolar ridges and/or the teeth.

One advantage of the invention is the fact that the pacifier according to the invention enables the child's jaw to develop naturally. In particular, the pacifier enables normal breadthwise growth of the upper jaw and thereby growth of the teeth without any malalignment or with considerably less serious malalignment.

In Finland the annual costs for the straightening of teeth are estimated at 200–300 million marks, several tens of billions in the world. Had 20–50% of the malalignment cases not developed and/or had their degree of seriousness diminished without requiring any other means than a correctly designed pacifier, the question would be considerable savings in the costs of health care.

The invention will now be described in greater detail with reference to the enclosed drawings in which FIG. 1 shows schematically a vertical cross-section of the buccal cavity and a conventional pacifier therein taken at the deciduous molars, FIG. 2 shows a vertical cross-section of the buccal cavity and a pacifier according to the invention therein taken at the deciduous molars along the line II—II in FIG. 4;

Figure 1:
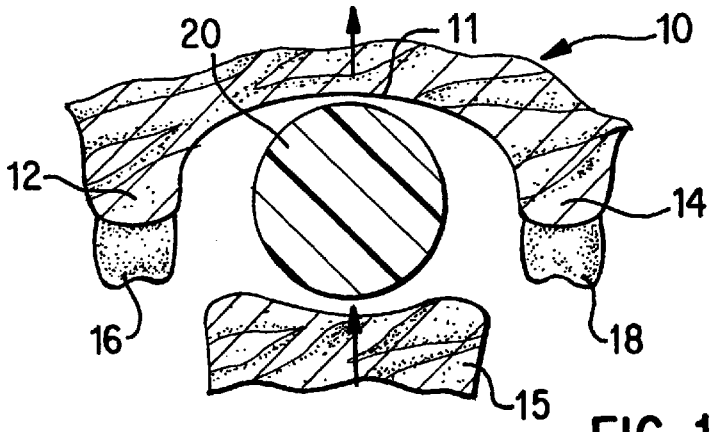
FIG. 1 PRIOR ART

FIG. 1 presents a cross-section of the buccal cavity 10 showing the palate 11, the alveolar ridges 12, 14 of the upper jaw, deciduous molars 16, 18 and the tongue 15. A pacifier 20 is in the mouth. While performing sucking motion the child's tongue presses the pacifier upwards in the direction indicated by the arrow. Thus the pacifier induces a pressure in the child's mouth only in the actual growth region of upper jaw at the midsuture of the palate at the point indicated by the arrow. At the same time, the pacifier prevents the tongue pressing normally towards the alveolar ridges and the teeth and exerting lateral pressure on them. These changes in pressure and the negative pressure induced by the sucking motion hinder the normal breadthwise growth of the child's upper jaw.

Figure 2:
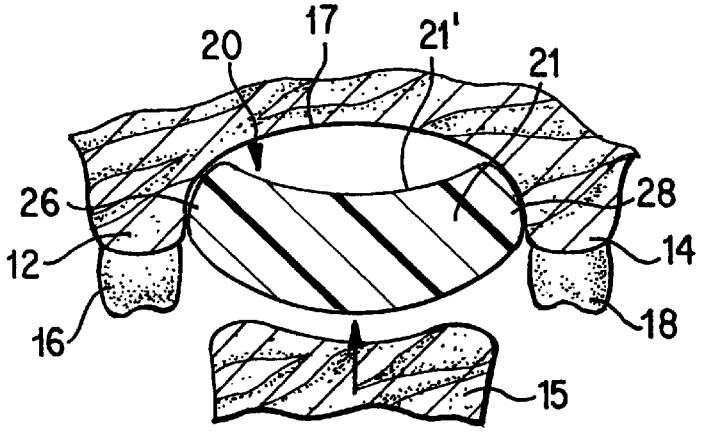

FIG. 2 presents a cross-section of the buccal cavity with a pacifier 20 according to the invention. It is seen that the cross-sectional profile 21 of the pacifier, viewed in a vertical cross-sectional plane of the buccal cavity, is slightly elongated. From the middle of the cross-section protrusions 26, 28 directed to both sides extend to the alveolar ridges 12, 14 of the child's upper jaw. The protrusions 26, 28 are shaped so as to induce from the child's sucking motions principally lateral outward pressure on the inside of the alveolar ridges and the deciduous teeth. The cross-sectional profile 21 of the nipple part may be slightly V-shaped or the upper edge 21' of the cross-sectional profile 21 may have a downwards curvature as in the figure. This kind of vertical profile ensures that the nipple part will not cause pressure on the middle section 17 of the palate when the tongue 15 presses the nipple 20 upwards. Instead, the pressure induced by the tongue is transmitted to the protrusions 26, 28 which in turn press the alveolar ridges 12, 14 sideways. The upper edge 21' of the profile 21 could also be straight. In all cases, it is important that the stiffness of the pacifier material be chosen so as to lead the force acting on the lower surface of the pacifier in the desired way.

Figure 3:
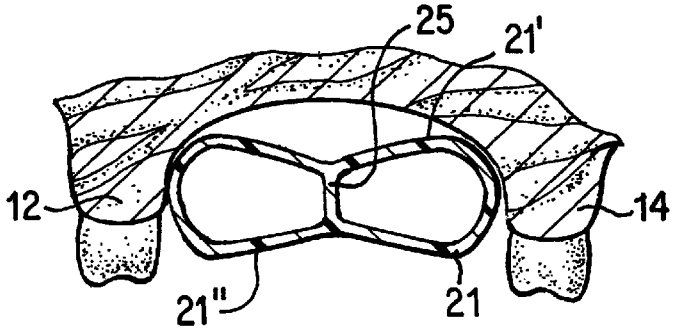
FIG. 3 shows a vertical cross-section of a pacifier according to FIG. 2 according to a second embodiment of the invention.

FIG. 3 shows a second embodiment of the pacifier according to the invention wherein the cross-sectional profile 21 of the nipple part is symmetric. This pacifier can be held in the mouth both ways. The lower surface 21" and the upper surface 21' of the nipple part are connected to one another by a connecting structure 25. Due to this structure 25 the force acting on the lower surface 21" of the pacifier tends to straighten the concave upper surface 21' and thereby increases the lateral force of the pacifier on the alveoli.

Figure 4:
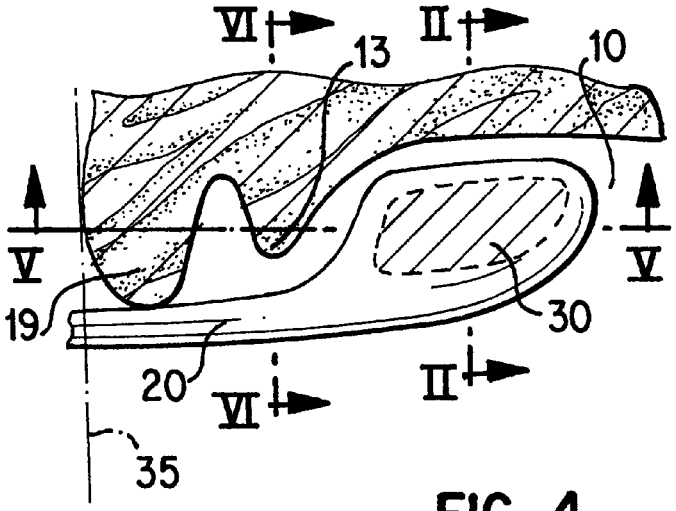
FIG. 4 shows a vertical longitudinal cross-section of the buccal cavity and a pacifier according to the invention.
Figure 6:
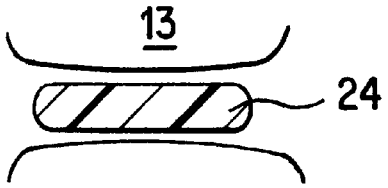
FIG. 6 shows a vertical cross-section of the pacifier according to invention along the line VI—VI of FIG. 4.

FIG. 4 shows a vertical longitudinal cross-section of the buccal cavity and a pacifier, including a shield 35, according to the invention therein. The buccal cavity is designated with the reference number 10 and the upper lip with the reference number 19. At the front part 13 of the alveolar ridge (line VI—VI) the pacifier is very flat and broad (Its vertical cross-section is shown in FIG. 6) and thereby the motion of the pacifier between the teeth alveoli and the teeth rows causes a minimal force component which pushes the teeth and the alveoli forwards. The surface 30 touching the side alveoli projected onto the cross-sectional plane of the midline is indicated by a dashed line.

Figure 5:
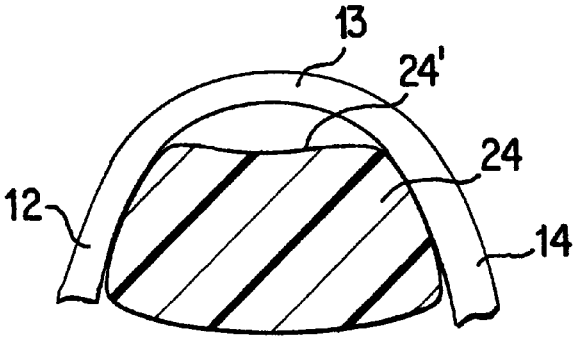
FIG. 5 shows a horizontal cross-section of the pacifier according to invention along the line V—V of FIG. 4.

FIG. 5 shows the cross-sectional profile 24 of the nipple part in a horizontal cross-section of the buccal cavity (along the cutting line V—V of FIG. 4). The cross-sectional profile 24 broadens towards the back of the buccal cavity and is approximately trapezoidal in shape. This shape ensures that the nipple part cannot come into contact with the front part 13 of the alveolar ridge by any force acting on the pacifier. Due to the trapezoidal shape of the cross-section, the nipple part cannot move forwards in the mouth without producing pressure on the lateral parts of the alveolar ridges. The figure further shows that the front edge 24' of the cross-section 24 of the nipple part may be slightly concave. This shape ensures that the pacifier cannot touch the front part 13 of the alveolar ridge.

The pacifier may have a through air channel which equalises the outside and inside pressures of the mouth, the pressure difference produced by sucking. The air channel may be designed so that compression of the pacifier does not induce pumping of air.

The pacifier may be made of previously known pacifier materials either as hollow (e.g. as seen in FIG. 3) or solid. Preferably, the pacifier material must be reversible so that once pressed it regains its original shape. It is of course possible to contemplate that the pacifier is made of such a material that it during the first time of use nearly permanently takes the desired shape i.e. the shape of the child's mouth.

The purpose is not to limit the invention to the embodiments presented above but, on the contrary, the invention is purposed to be applied widely within the inventive idea defined by the following claims.

We claim:

1. Baby pacifier comprising an actual nipple part, a shield, and a longitudinally extending part which merges with the actual nipple part, the longitudinally extending part having an upper surface adapted to face the upper lip of the baby, the longitudinally extending part having a longitudinal axis, the upper surface of the longitudinally extending part at a vertical plane passing through the longitudinal axis curving upwardly and merging into an upper surface of the actual nipple part, the actual nipple part comprising a piece made of elastic or resilient material to be held in the baby's mouth, at a location between the middle section of the palate and the tongue, on which piece the baby exerts suction by movements of the jaws and the tongue, wherein the actual nipple part is shaped so that a vertical cross-sectional profile, viewed in a vertical cross-sectional plane of the buccal cavity that is perpendicular to said longitudinal axis, is elongated with protrusions directed from a middle part of said vertical cross-sectional profile to both sides, said protrusions being shaped so as to create from the baby's sucking motion principally lateral outward pressure on the inside of the alveolar ridges and deciduous teeth of the baby when the actual nipple part is held in a baby's mouth, the vertical cross-sectional profile of the actual nipple part including an upper edge facing upwardly, said upper edge being concave so that the actual nipple part exerts essentially no pressure on the middle section of the palate.

2. Pacifier according to claim 1, wherein the protrusions a adapted to extend to the alvaeolar ridges and/or the teeth principally from the deciduous canine backwards to the second deciduous molar.

3. Pacifier according to claim 2, wherein a horizontal cross-sectional profile of the actual nipple part is symmetric and a connecting structure in a middle of the actual nipple part connects a lower surface with the upper surface of the actual nipple part.

4. Pacifier according to claim 1, wherein the vertical cross-sectional profile of the actual nipple part is symmetric and a connecting structure in a middle of the actual nipple part connects a lower surface with the upper surface of the actual nipple part.

5. Pacifier according to claim 4, wherein a horizontal cross-sectional profile of the actual nipple part in a horizontal cross-sectional plane of the buccal cavity broadens towards the back of the buccal cavity and is approximately trapezoidal so that the actual nipple part cannot come into contact with the front part of the alveolar ridge by any force acting on the pacifier, and so that the actual nipple part cannot move forwards in the mouth without producing pressure on the lateral parts of the alveolar ridges.

6. Pacifier according to claim 4, wherein a vertical cross-sectional profile of the nipple part in a vertical cross-sectional plane taken in the front part of the alveolar ridge is shaped flat and broad.

7. Pacifier according to claim 4, wherein the nipple part is made of an elastic solid material.

8. Pacifier according to claim 4, wherein the nipple part is hollow.

9. Pacifier according to claim 1, wherein a horizontal cross-sectional profile of the actual nipple part in a horizontal cross-sectional plane of the buccal cavity broadens towards the back of the buccal cavity and is approximately trapezoidal so that the actual nipple part cannot come into contact with the front part of the alveolar ridge by any force acting on the pacifier, and so that the actual nipple part cannot move forwards in the mouth without producing pressure on the lateral parts of the alveolar ridges.

10. Pacifier according to claim 9, wherein a front edge of the horizontal cross-sectional profile of the actual nipple part is provided with a concavity.

11. Pacifier according to claim 1, wherein a vertical cross-sectional profile of the nipple part in a vertical cross-sectional plane taken in the front part of the alveolar ridge is shaped flat and broad.

12. Pacifier according to claim 1, wherein the nipple part is made of an elastic solid material.

13. Pacifier according to claim 1, wherein the actual nipple part is hollow inside.

14. Baby pacifier comprising a longitudinally extending part which merges into an actual nipple part for being held in a baby's mouth at a location between the middle section of the palate and the tongue and on which the baby exerts suction by movements of the jaws and the tongue, the longitudinally extending part having a longitudinal axis and an upper surface adapted to face the upper lip of the baby, the upper surface of the longitudinally extending part curving upwardly and merging into an upper surface of the actual nipple part, the actual nipple part being made of elastic or resilient material, the actual nipple part being shaped so that a vertical cross-sectional profile, viewed in a vertical cross-sectional plane that is perpendicular to said longitudinal axis, of a portion of the actual nipple part that is adapted to be positioned in the buccal cavity of the baby's mouth is elongated and includes protrusions directed from a middle part of said vertical cross-sectional profile to opposite sides, said vertical cross-sectional profile of the actual nipple part having an upper edge, a portion of the upper edge of the actual nipple part being concave so that the actual nipple part exerts substantially no pressure on the middle section of the palate when the actual nipple part is positioned in the buccal cavity of the baby's mouth.

15. Pacifier according to claim 14, wherein the vertical cross-sectional profile of the actual nipple part is slightly V-shaped.

16. Pacifier according to claim 14, wherein the downwardly recessed upper edge of the actual nipple part is defined by a downward curvature.

17. Pacifier according to claim 14, wherein the vertical cross-sectional profile of the actual nipple part is symmetric and a connecting structure in a middle of the actual nipple part connects a lower surface with an upper surface of the actual nipple part.

18. Pacifier according to claim 14, wherein a front edge of a horizontal cross-sectional profile of the actual nipple part is provided with a concavity.

* * * * *